US008026888B2

(12) United States Patent
Nagai et al.

(10) Patent No.: US 8,026,888 B2
(45) Date of Patent: Sep. 27, 2011

(54) VOLTAGE SUPPLYING DEVICE

(75) Inventors: Hajime Nagai, Tokyo (JP); Hirofumi Watsuda, Tokyo (JP)

(73) Assignee: TPO Hong Kong Holding Limited, Shatin (HK)

( * ) Notice: Subject to any disclaimer, the term of this patent is extended or adjusted under 35 U.S.C. 154(b) by 1209 days.

(21) Appl. No.: 10/566,126

(22) PCT Filed: Jul. 28, 2004

(86) PCT No.: PCT/IB2004/051304

§ 371 (c)(1),
(2), (4) Date: Apr. 5, 2007

(87) PCT Pub. No.: WO2005/010859

PCT Pub. Date: Feb. 3, 2005

(65) Prior Publication Data

US 2007/0216820 A1 Sep. 20, 2007

(30) Foreign Application Priority Data

Jul. 30, 2003 (WO) ..... PCT/IB03/03375

(51) Int. Cl.
*G09G 3/36* (2006.01)

(52) U.S. Cl. ..... 345/98; 345/94

(58) Field of Classification Search ..... 345/98, 345/100, 93, 94; 349/37; 340/805
See application file for complete search history.

(56) References Cited

U.S. PATENT DOCUMENTS

| | | | | |
|---|---|---|---|---|
| 4,724,433 | A | 2/1988 | Inoue et al. | |
| 6,081,250 | A | 6/2000 | Shimada et al. | |
| 6,501,456 | B1 * | 12/2002 | Saito et al. | 345/98 |

FOREIGN PATENT DOCUMENTS

| | | |
|---|---|---|
| JP | 8-305322 | 11/1996 |
| JP | 9-081089 | 3/1997 |

* cited by examiner

*Primary Examiner* — Quan-Zhen Wang
*Assistant Examiner* — Yuk Chow
(74) *Attorney, Agent, or Firm* — Liu & Liu

(57) ABSTRACT

A voltage supplying device (1) comprising a video line (LV1), a video line (LVn), a source line (LS1) of a source line group (GS1) supplied with a gray scale voltage through the video line (LV1), a source line (LSn) of a source line group (GS1) supplied with a gray scale voltage through the video line (LVn), a source line (LS1) of a source line group (GS2) supplied with a voltage through the video line (LV1), and a controlling means for continuing to supply the source line (LSn) of the source line group (GS1) during a transition from a state in which the source line (LS1) of a source line group (GS1) is supplied with a voltage to a state in which the source line (LSn) of a source line group (GS1) is supplied with a voltage.

18 Claims, 6 Drawing Sheets

[Fig. 1]
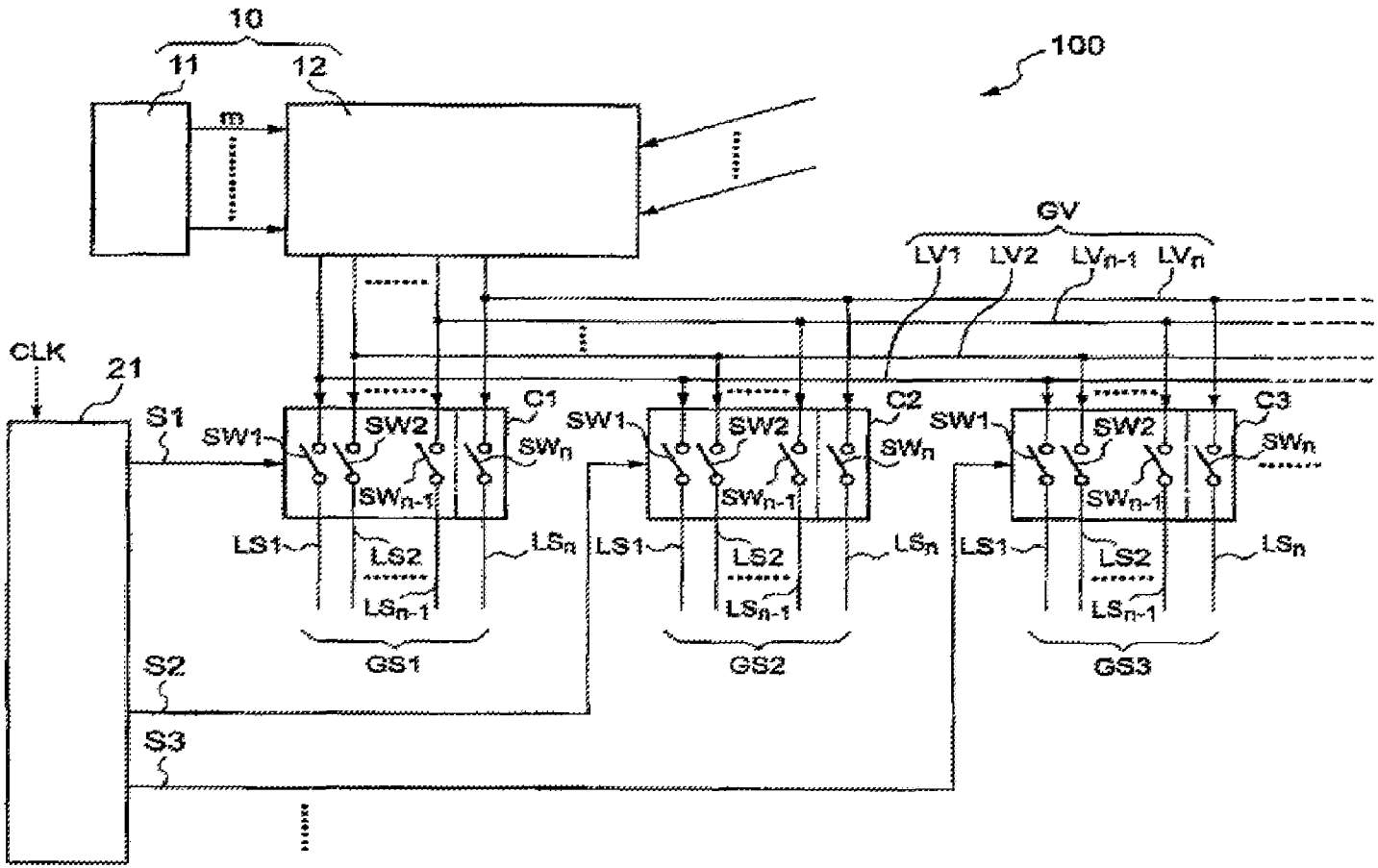
(PRIOR ART)

[Fig. 2]
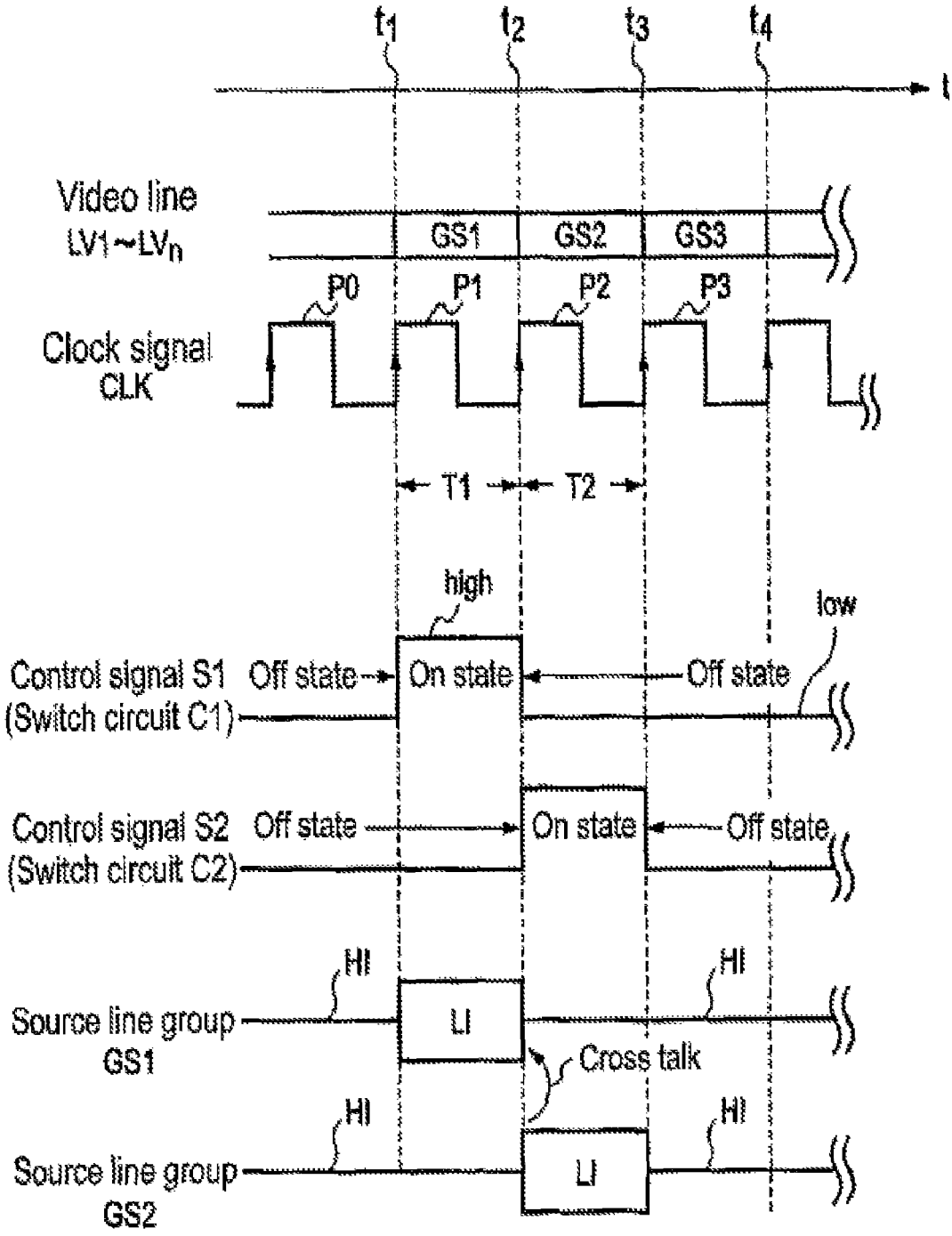
(PRIOR ART)

[Fig. 3]
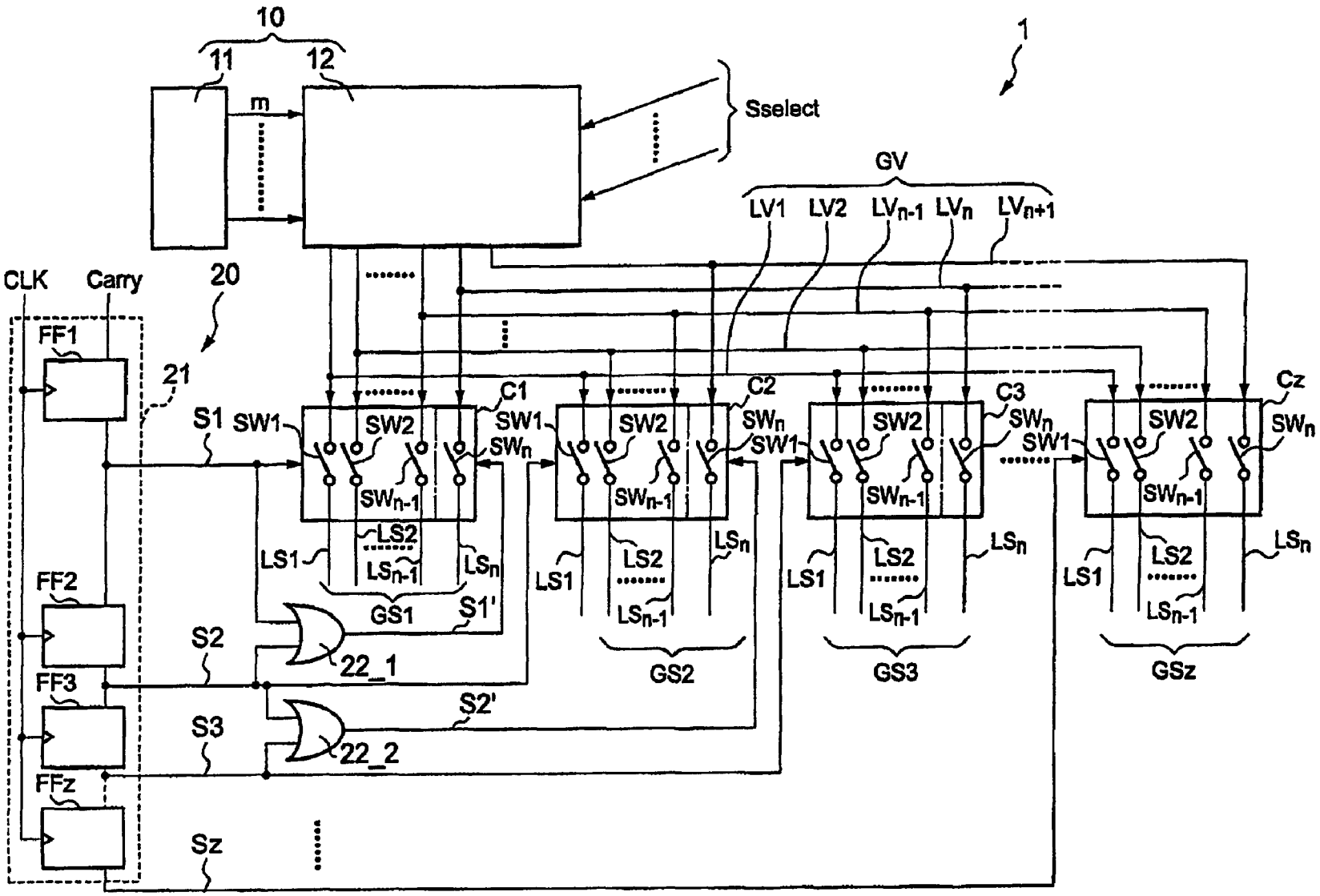

[Fig. 4]
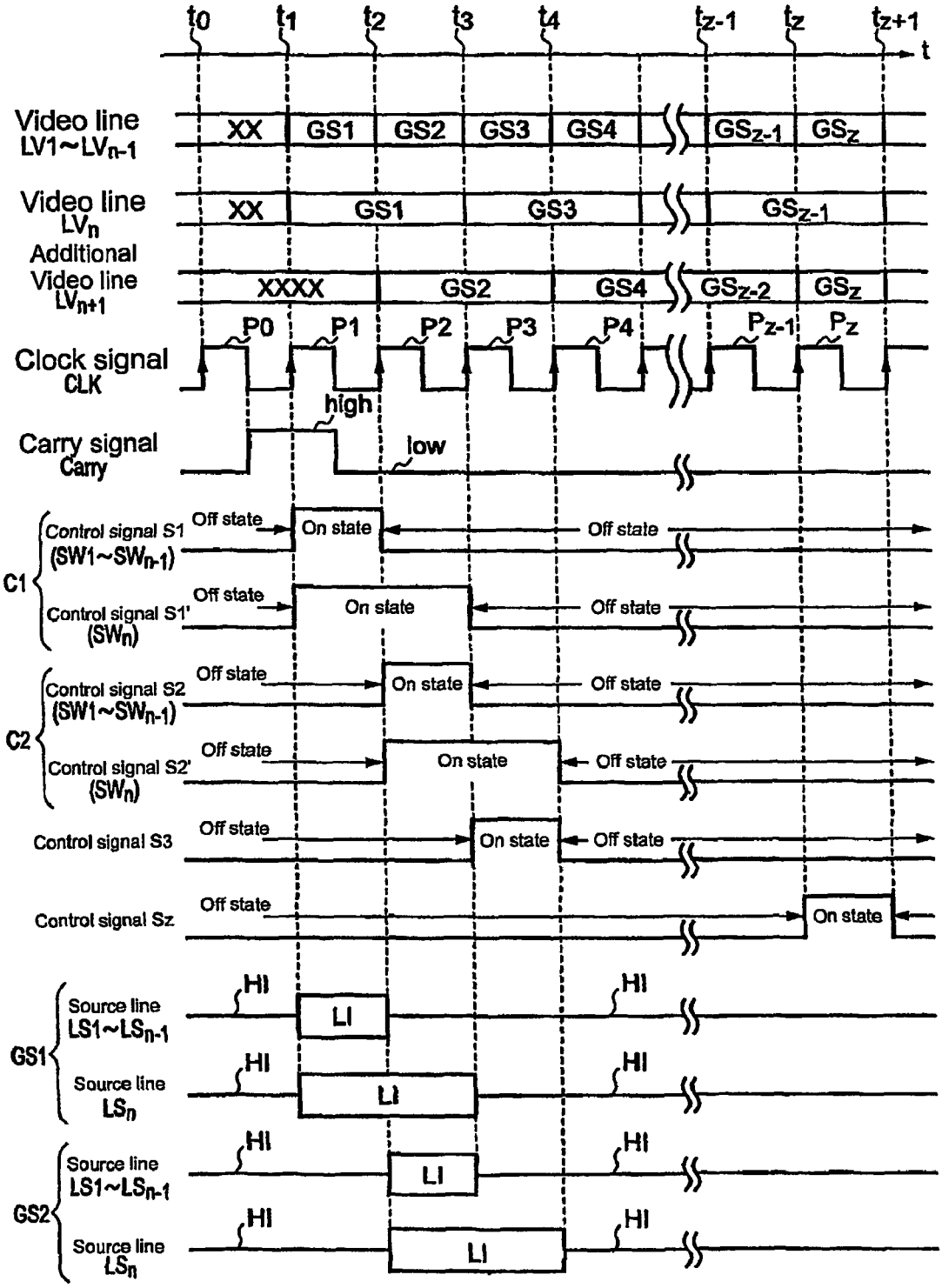

[Fig. 5]
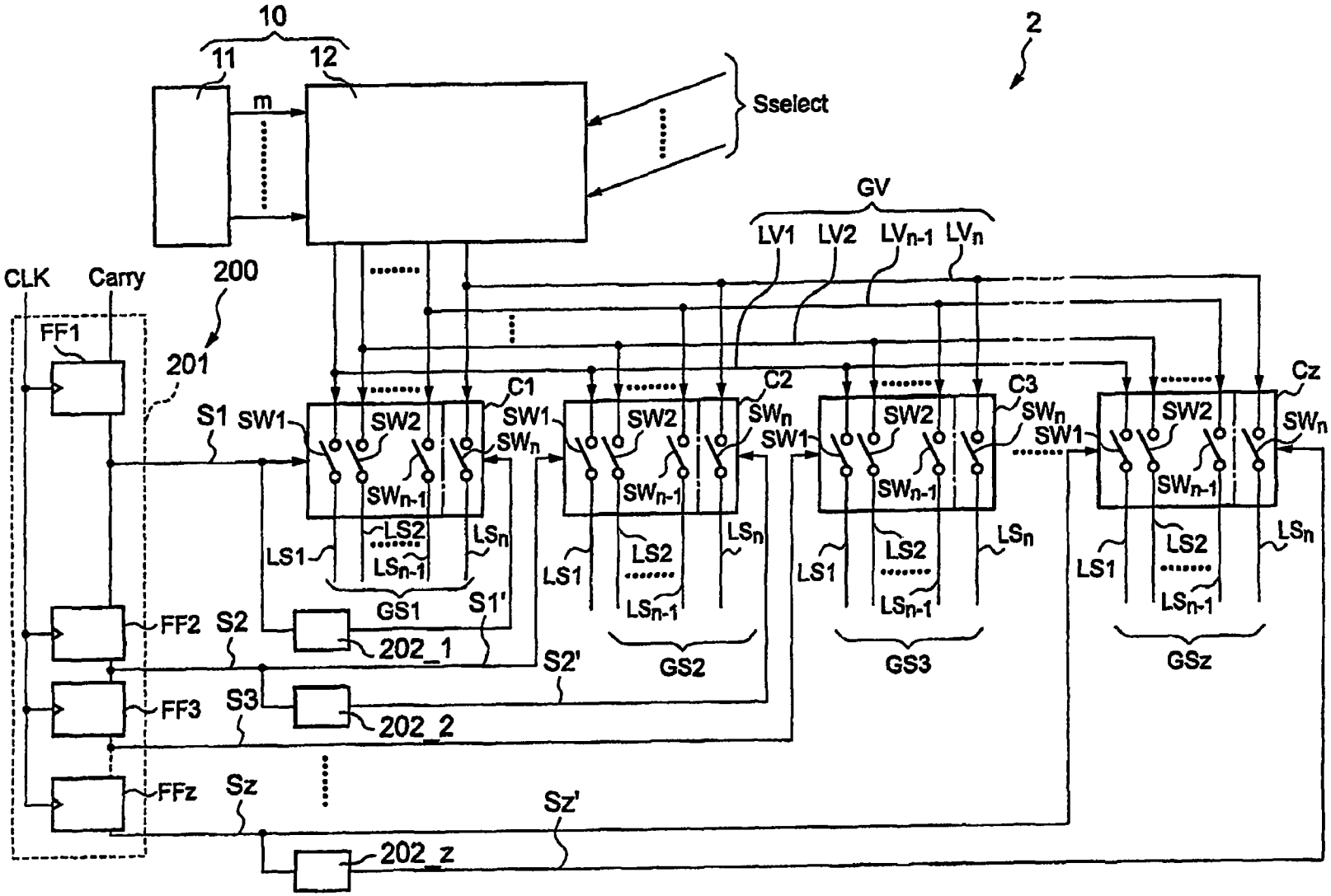

[Fig. 6]
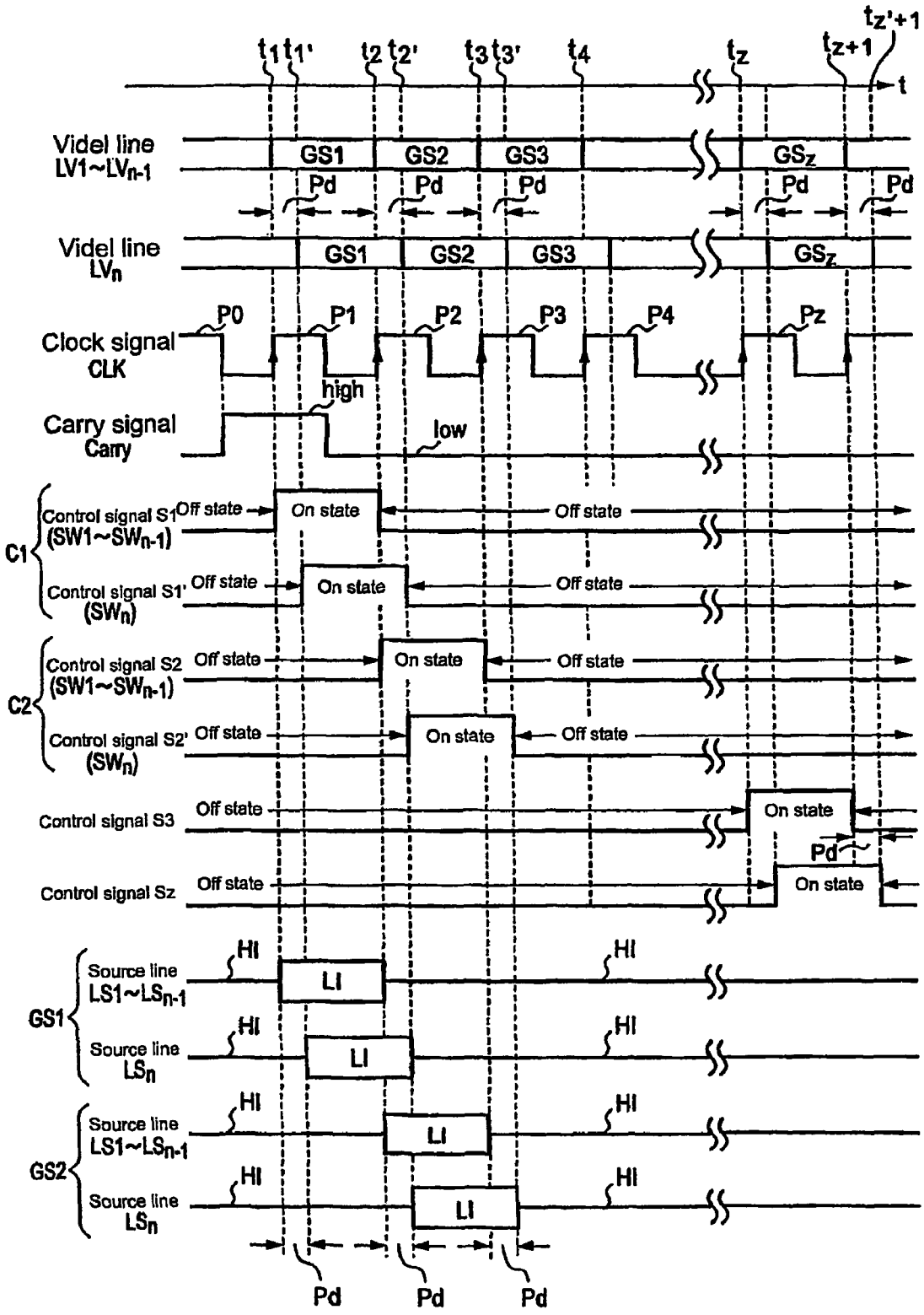

VOLTAGE SUPPLYING DEVICE

TECHNICAL FIELD

The invention relates to a voltage supplying device for supplying a pair of lines adjacent to each other with voltages.

BACKGROUND ART

A voltage supplying device for supplying source lines grouped as a plurality of source line groups with voltages has been known.

FIG. 1 is a schematic diagram showing one example of a conventional voltage supplying device 100.

The voltage supplying device 100 comprises a plurality of source line groups GS1, GS2, GS3, . . . . Each of the source line groups GS1, GS2, GS3, . . . consists of n source lines LS1 to LSn. The voltage supplying device 100 comprises a video line group GV in order to supply each of the source line groups GS1, GS2, GS3, . . . with gray scale voltages outputted from a gray scale voltage outputting means 10. The video line group GV comprises n video lines LV1 to LVn. The video line LV1 is a line for supplying a source line LS1 of each of source line groups GS1, GS2, GS3, . . . with voltages. Similarly, the other video lines LV2, . . . , LVn−1, LVn are lines for supplying source lines LS2, . . . , LSn−1, LSn of each of source line groups GS1, GS2, GS3, . . . with voltages. The voltage supplying device 100 comprises switch circuits C1, C2, C3, . . . associated with the source line groups GS1, GS2, GS3, . . . . Each of the switch circuits C1, C2, C3, . . . comprises n switching elements SW1 to SWn associated with n source lines LS1 to LSn. The voltage supplying device 100 comprises a shift register 21. The shift register 21 outputs control signals S1, S2, S3, . . . for controlling the switch circuits C1, C2, C3, . . . in synchronization with a clock signal CLK.

FIG. 2 shows a timing chart of the conventional voltage supplying device 100 shown in FIG. 1.

In the uppermost position of FIG. 2, a voltage profile on the video lines LV1 to LVn is shown every one clock period. It is noted that reference characters 'GS1', 'GS2', 'GS3' are described in the voltage profile. For example, the reference character 'GS1' is described in a period from times t1 to t2. This means that the gray scale voltages for source lines belonging to the source line group GS1 are supplied to the video lines LV1 to LVn during the period from times t1 to t2. A period from times t2 to t3 can be considered similarly to the period from times t1 to t2. The reference character 'GS2' is described in the period from times t2 to t3. This means that the gray scale voltages for source lines belonging to the source line group GS2 are supplied to the video lines LV1 to LVn. As described above, the video lines LV1 to LVn are supplied with gray scale voltages for the source line groups every one clock period.

Below the voltage profile of the video lines LV1 to LVn, a clock signal CLK is shown. A control signal S1 outputted from the shift register 21 has a high level voltage during a clock period T1 and a control signal S2 has a high level voltage one clock period later than the control signal S1 i.e. during the next clock period T2. Therefore, the source line group GS1 is in a low impedance state LI, during the period from times t1 to t2, in which it is connected to the video lines LV1 to LVn, whereas the source line group GS2 is in a low impedance state LI, during the period from times t2 to t3, in which it is connected to the video lines LV1 to LVn. Further, the source line group GS3 is in a low impedance state LI, during a period from times t3 to t4, in which it is connected to the video lines LV1 to LVn (not shown in FIG. 2).

In the voltage supplying device 100 shown in FIG. 1, the switch circuit C1 changes from the on-state to the off-state and the switch circuit C2 changes from the off-state to the on-state at time t2. Therefore, the source line group GS1 adjacent to the group GS2 changes from the low impedance state LI to the high impedance state HI, whereas the source lines group GS2 changes from the high impedance state HI to the low impedance state LI. In this case, the source line group GS2 is the low impedance state LI while the source line group GS1 is in the high impedance state HI, so that the supply of the voltage to the source line group GS1 is blocked. Therefore, in the case that the voltage on the source line LS1 of the source line group GS2 changes at the time when the source line group GS2 becomes the low impedance state LI, the voltage on the source line LSn of the source line group GS1 varies due to the cross talk, so that the voltage on the source line LSn of the source line group GS1 deviates from the original voltage. Ditto for the source lines LSn of the other source line groups.

An object of the present invention is to provide a voltage supplying device which can return a voltage on a line to the original voltage when the voltage on the line varies due to the cross talk between adjacent lines.

DISCLOSURE

The voltage supplying device for achieving the object described above according to the present invention comprises a pair of voltage lines, said voltage lines adjacent to each other and a controlling means for supplying one of said pair of voltage lines with a voltage during a transition from a state in which a supply of a voltage to the other of said pair of voltage lines is blocked to a state in which said other of said pair of voltage lines is supplied with a voltage. In this case, said controlling means may block the supply of the voltage to said one of said pair of voltage lines after said transition.

Under circumstances where a pair of voltage lines are adjacent to each other, if the voltage on the other of the voltage lines is changed by supplying the other of the voltage lines with the voltage, such a change in voltage may cause a variation in voltage on the one of the voltage lines due to the cross talk. However, according to the voltage supplying device of the present invention, the one of the voltage line continues to be supplied with the voltage, so that it is possible to return the voltage on the one of the voltage lines to the original voltage instantaneously.

Further, the voltage supplying device according to the present invention comprises a first relaying line, a second relaying line, a first voltage line supplied with a voltage through said first relaying line, a second voltage line supplied with a voltage through said second relaying line, a third voltage line supplied with a voltage through said first relaying line, said third voltage line adjacent to said second voltage line and a controlling means for continuing to supply said second voltage line with a voltage during a transition from a first voltage supplying state in which said first voltage line is supplied with a voltage to a second voltage supplying state in which said third voltage line is supplied with a voltage. In this case, said controlling means may block the supply of the voltage to said second voltage line after said transition from said first voltage supplying state to said second voltage supplying state.

In this voltage supplying device, the first relaying line is used for supplying not only the first voltage line but also the third voltage line with a voltage. In such a voltage supplying device, if the voltage on the third voltage lines is changed by supplying the third voltage line with a voltage, such a change in voltage on the third voltage line may cause a variation in voltage on the second voltage line adjacent to it due to the cross talk. However, according to this voltage supplying device of the present invention, the second voltage line continues to be supplied with a voltage, so that it is possible to return the voltage on the second voltage line to the original voltage instantaneously.

In the voltage supplying device according to the present invention, it is preferable that said controlling means supplies said first relaying line with a voltage for said third voltage line after supplying said first relaying line with a voltage for said first voltage line, and said controlling means continues to supply said second relaying line with a voltage for said second voltage line during a transition from a state in which said first relaying line is supplied with said voltage for said first voltage line to a state in which said first relaying line is supplied with said voltage for said third voltage line.

By supplying the second relaying line with the voltage for the second voltage line, the second voltage line is supplied with the voltage for the second voltage line through the second relaying line. Therefore, if the voltage on the second voltage line varies due to the cross talk between the second and third voltage lines, the voltage on the second voltage line returns instantaneously to the voltage for the second voltage line.

In the voltage supplying device according to the present invention, said controlling means may be adapted to switch from a disconnection state in which said third voltage line is disconnected from said first relaying line to a connection state in which said third voltage line is connected to said first relaying line, and said controlling means may continue to supply said second voltage line with said voltage for said second voltage line through said second relaying line during a transition from a disconnection state in which said third voltage line is disconnected from said first relaying line to a connection state in which said third voltage line is connected to said first relaying line.

When the third voltage line is connected to the first relaying line, the supply of the voltage to the third voltage line is started. If the voltage on the third voltage lines is changed by supplying the third voltage line with the voltage, such a change in voltage may cause a variation in voltage on the second voltage line adjacent to it due to the cross talk. However, by continuing to supply the second voltage line with the voltage, the voltage on the second voltage line can be instantaneously returned to the original voltage.

In the voltage supplying device according to the present invention, said controlling means may be further adapted to switch from a disconnection state in which said second voltage line is disconnected from said second relaying line to a connection state in which said second voltage line is connected to said second relaying line, and said controlling means may continue to keep a connection state in which said second voltage line is connected to said second relaying line during a transition from a disconnection state in which said third voltage line is disconnected from said first relaying line to a connection state in which said third voltage line is connected to said first relaying line.

By keeping the connection state in which the second voltage line is connected to the second relaying line as described above, the second voltage line is supplied with the voltage. Therefore, if the voltage on the second voltage line varies due to the cross talk between the second and third voltage lines, the voltage on the second voltage line can be instantaneously returned to the original voltage.

In the voltage supplying device according to the present invention, said controlling means may comprise a first switching means for making a connection state in which said first voltage line is connected to said first relaying line and a disconnection state in which said first voltage line is disconnected from said first relaying line, a second switching means for making a connection state in which said second voltage line is connected to said second relaying line and a disconnection state in which said second voltage line is disconnected from said second relaying line and a third switching means for making a connection state in which said third voltage line is connected to said first relaying line and a disconnection state in which said third voltage line is disconnected from said first relaying line, and said controlling means comprises a switch controlling means for controlling said first, second, and third switching means in such a way that a connection state in which said second voltage line is connected to said second relaying line is kept during a transition from a first state in which said first voltage line is connected to said first relaying line and said third voltage line is disconnected from said first relaying line to a second state in which said first voltage line is disconnected from said first relaying line and said third voltage line is connected to said first relaying line.

When the voltage on the second voltage line varies due to the cross talk between the second and third voltage lines, the voltage on the second voltage line can be instantaneously returned to the original voltage by controlling on-states and off-states of the first, second and third switching means using the switch controlling means as described above.

In the voltage supplying device according to the present invention, said first switching means may connect said first voltage line to said first relaying line in its on state and disconnect said first voltage line from said first relaying line in its off state, said second switching means may connect said second voltage line to said second relaying line in its on state and disconnect said second voltage line from said second relaying line in its off state, said third switching means may connect said third voltage line to said first relaying line in its on state and disconnect said third voltage line from said first relaying line in its off state, and said switch controlling means may control said first, second, and third switching means in such a way that said second switching means keeps on state during a transition of said first switching means from on state to off state and a transition of said third switching means from off state to on state. When the voltage on the second voltage lines varies due to the cross talk between the second and third voltage lines, the voltage on the second voltage line can be instantaneously returned to the original voltage by controlling the first, second and third switching means using the switch controlling means.

In the voltage supplying device according to the present invention, said switch controlling means may output a first control signal for controlling said first switching means, a second control signal for controlling said second switching means, and a third control signal for controlling said third switching means, said first control signal may have an first on-voltage for turning said first switching means to an on-state and an first off-voltage for turning said first switching means to an off-state, said second control signal may have an second on-voltage for turning said second switching means to an on-state and an second off-voltage for turning said second switching means to an off-state, said third control signal may have an third on-voltage for turning said third switching means to an on-state and an third off-voltage for turning said third switching means to an off-state, said switch controlling means may output said first and third control signals in such a way that a transition of said third control signal from said third off-voltage to said third on-voltage is made when a transition of said first control signal from said first on-voltage to said first off-voltage is made, and said switch controlling means may output said second control signals in such a way that said second control signal has said second on-voltage during a transition of said third control signal from said third off-voltage to said third on-voltage.

By outputting such the first, second and third control signals from the switch controlling means, the second switching means keeps on state during a transition of the third switching means from off state to on state. Therefore, when the voltage on the second voltage line varies due to the cross talk between the second and third voltage lines, the voltage on the second voltage line can be instantaneously returned to the original voltage.

In the voltage supplying device according to the present invention, said switch controlling means may comprise an OR circuit for implementing the logic sum of said first control signal and said third control signal to output a signal representing said logic sum of said first and second control signals as said second control signal.

By providing with such OR circuit, the second control signal for keeping the second switching means on-state during a transition of the third switching means from off-state to on-state is generated. Therefore, when the voltage on the second voltage line varies due to the cross talk between the second and third voltage lines, the voltage on the second voltage line can be instantaneously returned to the original voltage.

In the voltage supplying device according to the present invention, it is preferable that said switch controlling means comprises an delay circuit for delaying said first control signal to output said delayed first control signal as said second control signal.

By providing with the delay circuit for delaying the first control signal instead of the OR circuit, the second control signal for keeping the second switching means on state during a transition of the third switching means from off state to on state can be generated. Therefore, when the voltage on the second voltage line varies due to the cross talk between the second and third voltage lines, the voltage on the second voltage line can be instantaneously returned to the original voltage.

In the voltage supplying device according to the present invention, said supplying device may comprise an additional relaying line, a first voltage line group having said first voltage line and said second voltage line and a second voltage line group having said third voltage line and a fourth voltage line supplied with a voltage through said additional relaying line.

When the second relaying line is being used to supply the second voltage line belonging to the first voltage line group with the voltage, the second relaying line can not be used to supply different voltage lines from the second voltage line with the voltage. In such case, if the additional relaying line is provided, the forth voltage line can be supplied with the voltage through the additional relaying line while supplying the second voltage line with the voltage through the second relaying line. Therefore, when the second relaying line is being used to supply the second voltage line belonging to the first voltage line group with the voltage, the supply of the voltages to the third and fourth voltage lines belonging to the second voltage line group can start simultaneously.

The voltage supplying device according to the present invention can be adapted in such a way that said supplying device comprises a fifth voltage line supplied with a voltage through said first relaying line, said fifth voltage line adjacent to said fourth voltage line, and said controlling means continues to supply said fourth relaying line with a voltage through said additional relaying line during a transition from a state in which said third voltage line is supplied with a voltage through said first relaying line to a state in which said fifth voltage line is supplied with a voltage through said first relaying line.

Under the condition that the first relaying line is used for supplying not only the third voltage line but also the fifth voltage line with the voltage, when the fifth voltage line is supplied with the voltage, the first relying line is connected to the fifth voltage line instead of the third voltage line. In such case, if the voltage on the fifth voltage line is changed by supplying the fifth voltage line with the voltage, the voltage on the fourth voltage line may vary due to the cross talk since the fifth voltage line is adjacent to the fourth voltage line. However, the voltage on the fourth voltage line can be returned to the original voltage instantaneously by continuing to supply the fourth voltage line with the voltage through the additional relaying line as described above.

A voltage supplying device according to the present invention comprises a first relaying line, a second relaying line, a first voltage line supplied with a voltage through said first relaying line, a second voltage line supplied with a voltage through said second relaying line, a third voltage line supplied with a voltage through said first relaying line, said third voltage line adjacent to said second voltage line and a controlling means for switching from a first voltage supplying state in which said first voltage line is supplied with a voltage to a second voltage supplying state in which said third voltage line is supplied with a voltage during supply of a voltage to said second voltage line.

In this voltage supplying device, the switching of the supply of the voltage from the first voltage line to the third voltage line is performed during the supply of the voltage to the second voltage line. In this case, if the voltage on the second voltage line varies due to the cross talk between the second and third voltage lines, it is possible to return the voltage on the second voltage line to the original voltage instantaneously since the second voltage line is being supplied with the voltage.

DESCRIPTION OF DRAWINGS

FIG. 1 is a schematic diagram showing one example of the conventional voltage supplying device 100.

FIG. 2 shows a timing chart of the conventional voltage supplying device 100 shown in FIG. 1.

FIG. 3 is a schematic diagram showing the voltage supplying device 1 of the first embodiment according to the preset invention applied to the image display device.

FIG. 4 shows a timing chart of the voltage supplying device 1 shown in FIG. 3.

FIG. 5 is a schematic diagram showing the voltage supplying device 2 of the second embodiment according to the preset invention applied to the image display device.

FIG. 6 shows a timing chart of the voltage supplying device 2 shown in FIG. 5.

BEST MODE

FIG. 3 is a schematic diagram showing a voltage supplying device 1 of the first embodiment according to the present invention applied to an image display device. FIG. 4 shows a timing chart of the voltage supplying device 1 shown in FIG. 3.

The voltage supplying device 1 comprises a gray scale voltage outputting means 10, a video line group GV, switch circuits C1 to Cz, source line groups GS1 to GSz, and a switch circuit controlling means 20 as main elements. The gray scale voltage outputting means 10 outputs gray scale voltages and then supplies the video line group GV with such gray scale voltages. The voltages supplied to the video line group GV are supplied via the switch circuits C1 to Cz to their respective source line groups GS1 to GSz. Each of the source line groups GS1 to GSz consists of n source lines LS1 to LSn in this embodiment, but the source line groups may be different from each other in the number of source lines. The switch circuits C1 to Cz are controlled by the switch circuit controlling means 20.

Hereinafter, it is described in detail how the voltage supplying device 1 shown in FIG. 3 supplies the source lines with the voltages.

The gray scale voltage outputting means 10 comprises a gray scale voltage generating circuit 11 and a gray scale voltage selecting circuit 12. The gray scale voltage generating circuit 11 generates m gray scale voltages (for example, 64 gray scale voltages) different from each other in voltage level and then outputs the m generated gray scale voltages to the gray scale voltage selecting circuit 12.

The gray scale voltage selecting circuit 12 selects one of m gray scale voltages for each of the video lines LV1 to LVn+1 of the video line group GV on the basis of a selecting signal Sselect, and then supplies the video line group GV with the selected gray scale voltages. The gray scale voltage outputting means 10 is not limited to the constitution shown in FIG. 3 as long as it can output gray scale voltages required for the video lines LV1 to LVn+1 of the video line group GV.

The video line group GV comprises (n+1) video lines LV1 to LVn+1 for supplying the source line groups GS1 to GSz with the gray scale voltages. For example, the source line LS1 of each of the source line groups GS1 to GSz is supplied with the gray scale voltage through the video line LV1. Therefore, by controlling the switch circuits C1 to Cz, the source line LS1 of each of the source line groups GS1 to GSz can be supplied with the gray scale voltage using one video line LV1. The source lines LS2 to LSn−1 can be considered similarly to the source line LS1 and are supplied with their respective gray scale voltages through the video lines LV2 to LVn−1. As described above, in the case of the source lines LS1 to LSn−1 of the source lines LS1 to LSn, the source lines indicated with the same reference characters are supplied with the gray scale voltages through the same video line irrespective of which source line groups the source lines belong to. However, it is noted that, depending on which source line groups the source lines LSn belong to, the source lines LSn are supplied with gray scale voltages from different video lines. For this purpose, the video line group GV comprises not only the video lines LV1 to LVn−1 but also a video line LVn and an additional video line LVn+1. The video line LVn is provided for supplying the source lines LSn belonging to odd-numbered source line groups GS1, GS3, . . . with the gray scale voltages, whereas the additional video line LVn+1 is provided for supplying the source lines LSn belonging to even-numbered source line groups GS2, GS4, . . . with the gray scale voltages. It is noted that the last source line group GSz may be odd-numbered source line group or even-numbered source line group, depending on whether the total number of the source line groups GS1 to GSz is odd or even. If the last source line group GSz is odd-numbered source line group, the source line LSn belonging to the last source line group GSz is supplied with the gray scale voltage from the video line LVn. If the last source line group GSz is even-numbered source line group, the source line LSn belonging to the last source line group GSz is supplied with the gray scale voltage from the additional video line LVn+1. Herein, the explanation is given with the assumption that the last source line group GSz is even-numbered source line group. Therefore, the source line LSn belonging to the last source line group GSz is supplied with the gray scale voltage from the additional video line LVn+1. As described above, unlike the source lines LS1 to LSn−1, the source lines LSn are supplied with the gray scale voltages from the video lines LVn or LVn+1. This is specifically shown in a timing chart of FIG. 4. At the upper part of FIG. 4, voltage profiles of the video lines LV1 to LVn−1, the video line LVn, and the additional video line LVn+1 are shown in order from the top position. It is noted that the reference characters 'GS1', 'GS2', 'GS3' and others are described in the voltage profiles of the video lines. For example, in the voltage profiles of the video lines LV1 to LVn−1, the reference characters 'GS1', 'GS2', 'GS3', 'GS4', . . . , 'GSz−1' and 'GSz' are described every one clock period. More specifically, for example between times t1 and t2, the reference character 'GS1' is described. This means that the gray scale voltages for source lines belonging to the source line group GS1 are supplied to the video lines LV1 to LVn−1 during period from times t1 to t2. Similarly, the reference character 'GSz' is described between times tz and tz+1, which means that the gray scale voltages for source lines belonging to the source line group GSz are supplied to the video lines LV1 to LVn−1. In this way, the video lines LV1 to LVn−1 are supplied with the gray scale voltages for each of the source line groups every one clock period.

In contrast to above description, in the voltage profile of the video line LVn (which corresponds to 'second relaying line' of the present invention), the reference characters 'GS1', 'GS3', . . . , 'GSz−1' are described every two clock periods. More specifically, for example between times t1 and t3, the reference character 'GS1' is described. This means that the gray scale voltages for the source line LSn belonging to the source line group GS1 are supplied to the video line LVn between times t1 and t3. Similarly, the reference character 'GSz−1' is described between times tz−1 and tz+1, which means that the gray scale voltages for source line LSn belonging to the source line group GSz−1 are supplied to the video line LVn. In this way, the gray scale voltages for the source lines LSn belonging to the odd-numbered source line groups are supplied to the video line LVn every two clock periods.

On the other hand, in the voltage profile of the additional video line LVn+1 (which corresponds to 'additional relaying line' of the present invention), the reference characters 'GS2', 'GS4', . . . , 'GSz−2' and 'GSz' are described, so that the gray scale voltages for the source lines LSn belonging to the even-numbered source line groups are supplied in sequence. The additional video line LVn+1 is supplied with the voltages one clock period later than the video line LVn. Like the video line LVn, the additional video line LVn+1 is basically supplied with the gray scale voltages every two clock periods. However, it is noted that the reference character 'GSz' described at the end of the voltage profile of the additional vide line LVn+1 is described only between times tz and tz+1 (i.e. one clock period). Therefore, the gray scale voltages for the source line LSn belonging to the source line group GSz are supplied to the additional video line LVn+1 for only one clock period.

The voltage supplying device 1 comprises z switch circuits C1 to Cz corresponding to z source line groups GS1 to GSz. The switch circuits C1 to Cz operate in such a way that their respective source line groups are connected to or disconnected from the video line group GV. For the purpose of such operation, each of the switch circuits C1 to Cz comprises n switch elements SW1 to SWn corresponding to n source lines LS1 to LSn. Each of the switch elements becomes off-state in response to a low level voltage and becomes on-state in response to a high level voltage. Each of the switch circuits C1 to Cz comprising such switch elements connects the source lines LS1 to LSn−1 of the source lines LS1 to LSn to the video lines LV1 to LVn−1. However, it is noted that the odd-numbered switch circuits C1, C3, . . . connect their respective source lines LSn to the video line LVn and that the even-numbered switch circuits C2, C4, . . . connect their respective source lines LSn to the additional video line LVn+1 (not the video line LVn).

The voltage supplying device 1 comprises a switch circuit controlling means 20 in order to drive the switch circuits C1 to Cz as described above. The switch circuit controlling means 20 comprises a shift register 21. The shift register 21 comprises D flip-flops FF1 to FFz corresponding to the switch circuits C1 to Cz. The D flip-flops FF1 to FFz are cascaded. The first D flip-flop FF1 of the D flip-flops FF1 to FFz receives a carry signal Carry. This carry signal Carry changes from a low level voltage to a high level voltage at the falling edge of the pulse P0 of the clock signal CLK and changes from a high level voltage to a low level voltage at the rising edge of the next pulse P1. Since the pulse P1 of the clock signal CLK rises when the carry signal Carry is the high level voltage, the first D flip-flop FF1 takes the high revel voltage of the carry signal Carry in response to the rising edge of the pulse P1 and outputs it. The high level voltage from the D flip-flop FF1 is outputted as an input signal of the next D flip-flop FF2 and also outputted as a control signal S1 of the switch circuit C1. Since the carry signal Carry is low level voltage at the rising time t2 of the next pulse P2, the first D flip-flop FF1 takes the low level voltage and outputs it to the next D flip-flop FF2 and the switch circuit C1. Therefore, the signal from the D flip-flop FF1 keeps the high level voltage during a period from times t1 to t2 and keeps the low level voltage after time t2 until the D flip-flop FF1 takes a new high level voltage. The D flip-flops FF2 to FFz delay the signal outputted from the first D flip-flop FF1 by one clock period and output it in response to the pulses of the clock signal CLK. Like the signal outputted from the first D flip-flop FF1, the signals outputted from the D flip-flops FF2 to FFz are supplied to their respective switch circuits C2 to Cz as control signals S2 to Sz.

In this way, the signals outputted from the D flip-flops FF1 to FFz are supplied to their respective switch circuits C1 to Cz as the control signals S1 to Sz. The control signal Sz of the control signals S1 to Sz controls all of n switch elements SW1 to SWn composing the switch circuit Cz. However, it is noted that the other control signals S1 to Sz−1 do not control all of n switch elements SW1 to SWn composing the corresponding switch circuit, but control (n−1) switch elements SW1 to SWn−1. For example, the control signal S1 dose not control all of n switch elements SW1 to SWn composing the corresponding switch circuit C1, but controls (n−1) switch elements SW1 to SWn−1. Ditto for the other control signals S2 to Sz−1. That is to say, it is noted that each of the control signals S1 to Sz−1 can control (n−1) switch elements SW1 to SWn−1 belonging to the corresponding switch circuit, but can not control switch element SWn. For the purpose of controlling the switch elements SWn which can not be controlled by the control signals S1 to Sz−1, the switch circuit controlling means 20 comprises not only the shift register 21 but also (z−1) OR circuits 22_1 to 22_z−1 corresponding to the (z−1) switch circuits C1 to Cz−1 (In FIG. 3, OR circuits 22_1 and 22_2 are shown, but the other OR circuits are omitted). The OR circuit 22_1 outputs, as a control signal S1', an OR signal representing OR of the control signal S1 inputted to the corresponding switch circuit C1 and the control signal S2 inputted to the adjacent switch circuit C2. The opening and closing of the switch element SWn of the switch circuit C1 is performed by the control signal Sr. In the similar way, the other OR circuits 22_2 to 22_z−1 also output control signals S2' to Sz−1' for performing the opening and closing of the switch elements SWn of the corresponding switch circuits C2 to Cz−1, respectively.

Next, the operation of the voltage supplying device 1 constructed as described above is explained with reference to FIGS. 3 and 4.

For the purpose of supplying the source lines LS1 to LSn−1 of the source line group GS1 with gray scale voltages, the voltage supplying device 1 supplies the video lines LV1 to LVn−1 with the corresponding gray scale voltages during a period from times t1 to t2. Further, for the purpose of supplying the source line LSn of the source line group GS1 with the gray scale voltage, the voltage supplying device 1 supplies the video lines LVn with the corresponding gray scale voltages during a period from times t1 to t3.

The D flip-flop FF1 takes the high level voltage of the carry signal Carry in synchronization with the rising edge of the pulse P1 of the clock signal CLK and continues to output the high level voltage until the next pulse P2 rises. Therefore, the control signal S1 is the high level voltage during a period from times t1 to t2, so that the switch elements SW1 to SWn−1 of the switch circuit C1 become on-state. The source lines LS1 to LSn−1 of the source line group GS1 become the low impedance states LI (see FIG. 4) in which they are connected to their respective video lines LV1 to LVn−1 through the switch elements SW1 to SWn−1 in on-states. Therefore, the source lines LS1 to LSn−1 of the source line group GS1 are supplied with their respective gray scale voltages from the video lines LV1 to LVn−1. The control signal S1 is inputted to not only the switch circuit C1 but also the OR circuit 22_1. The OR circuit 22_1 receives not only the control signal S1 but also the control signal S2. If the control signal S1 is the high level voltage, the OR circuit 22_1 outputs the high level voltage irrespective of the voltage level of the control signal S2. Therefore, the control signal S1' is the high level voltage during a period from times t1 to t2, so that not only the switch elements SW1 to SWn−1 of the switch circuit C1 but also the switch element SWn become on-state. Therefore, the source lines LSn of the source line group GS1 also becomes the low impedance state LI in which it is connected to the video line LVn through the switch element SWn of the switch circuit C1, so that the cor-responding gray scale voltage is supplied from the video line LVn.

That is to say, all of the source lines LS1 to LSn of the source line group GS1 are supplied with their respective gray scale voltages from the video lines LV1 to LVn through all of the switch elements SW1 to SWn of the switch circuit C1 during a period from times t1 to t2. Further, in the case of the other switch circuits C2 to Cz, all of the switch elements are off-states, so that the gray scale voltages for the source line group GS1 are not supplied to the other source line groups GS2 to GSz.

Next, for the purpose of supplying the source lines LS1 to LSn−1 of the source line group GS2 with gray scale voltages, the video lines LV1 to LVn−1 are supplied with the gray scale voltages for the source line group GS2 during a period from times t2 to t3. Therefore, the video lines LV1 to LVn−1 are supplied with the gray scale voltages for the source line group GS1 during a period from times t1 to t2, but are supplied with the gray scale voltages for the source line group GS2 during a period from times t2 to t3. However, it is noted that the gray scale voltage for the source line LSn belonging to the source line group GS1 is supplied to the video line LVn during not only a period from times t1 to t2 but also a period from times t2 to t3. This reason will be described later.

Further, at time t2, the switch elements SW1 to SWn−1 of the switch circuit C1 change from on-state to off-state since the control signal S1 changes the high level voltage to the low level voltage. Therefore, the source lines LS1 to LSn−1 of the source line group GS1 become high impedance states HI in which they are disconnected from the video lines LV1 to LVn−1. As a result of this, the gray scale voltages for the source line group GS2 supplied to the video lines LV1 to LVn−1 during a period from times t2 to t3 are prevented from being supplied to the source lines LS1 to LSn−1 of the source line group GS1.

Furthermore, at time t2, the switch elements SW1 to SWn−1 of the switch circuit C2 change from off-state to on-state since the control signal S2 changes the low level voltage to the high level voltage. The source lines LS1 to LSn−1 of the source line group GS2 become low impedance states LI in which they are connected to their respective video lines LV1 to LVn−1 through the switch elements SW1 to SWn−1 in on-states. Therefore, the source lines LS1 to LSn−1 of the source line group GS2 are supplied with their respective gray scale voltages from the video lines LV1 to LVn−1.

It is noted that, at time t2, the control signal S1 changes from the high level voltage to the low level voltage, but the control signal S2 changes from the low level voltage to the high level voltage. Since the control signals S1 and S2 change like this, the control signal S1' outputted from the OR circuit 22_1 keeps the high level voltage during a period from times t1 to t3, so that the switch element SWn of the switch circuit C1 keeps on-state during a period from times t1 to t3. Therefore, the switch elements SW1 to SWn−1 of the switch circuit C1 is off-state from time t2, but the switch element SWn of the switch circuit C1 keeps on-state until time t3 after time t2. As a result of this, the source line LSn of the source line group GS1 becomes low impedance state LI in which it is connected to the video line LVn during a period from times t1 to t3. Therefore, the source line LSn of the source line group GS1 is supplied with the corresponding gray scale voltage from the video line LVn during a period from times t1 to t3. That is to say, the source line LSn of the source line group GS1 continues to be supplied with the corresponding gray scale voltage from the video line LVn while the source line LS1 of the source line group GS2 completely changes from the high impedance state HI to the low impedance state LI at time t2. Therefore, if the voltage on the source line LSn of the source line group GS1 varies due to the cross talk at the instance when the source line LS1 of the source line group GS2 becomes the low impedance state LI (time t2), the voltage on the source line LSn of the source line group GS1 returns to the original gray scale voltage instantaneously. By changing the source line LS1 of the source line group GS2 from the high impedance state HI to the low impedance state LI while the source line LSn of the source line group GS1 is supplied with the gray scale voltage as described above, the degradation of the quality of image is prevented.

It is noted that, in the voltage supplying device 1 shown in FIG. 3, the gray scale voltage for the source line LSn belonging to the source line group GS1 is supplied to the video line LVn during not only a period from times t1 to t2 but also a period from times t2 to t3 in order to prevent the degradation of the quality of image. Therefore, the source line LSn belonging to the source line group GS2 can not be supplied with the required gray scale voltage from the video line LVn during a period from times t2 to t3. So, the voltage supplying device 1 shown in FIG. 3 comprises not only n video lines LV1 to LVn but also the additional video line LVn+1. The video line LVn is supplied with the gray scale voltage for the source line LSn of each of the odd-numbered source line groups GS1, GS3, . . . , but the additional video line LVn+1 is supplied with the gray scale voltage for the source line LSn of each of the even-numbered source line groups GS2, GS4, . . . .

The gray scale voltage for the source line LSn belonging to the source line group GS2 is supplied to the additional video line LVn+1 during a period from times t2 to t4. Further, during a period from times t2 to t3, the control signal S2' outputted from the OR circuit 22_2 is the high level voltage since the control signal S2 is high level voltage. As a result, in the switch circuit C2, not only the switch elements SW1 to SWn−1 but also the switch element SWn are closed. Therefore, the source line LSn of the source line group GS2 becomes the low impedance state LI in which it is connected to the additional video line LVn+1, so that this source line LSn is supplied with the corresponding gray scale voltage from the additional video line LVn+1.

In order to supply the source lines LS1 to LSn of the source line group GS3 with the gray scale voltages, the gray scale voltages for the source lines LS1 to LSn−1 of the source line group GS3 are supplied to the video lines LV1 to LVn−1 during a period from times t3 to t4, and the gray scale voltages for the source line LSn of the source line group GS3 is supplied to the video line LVn during a period from times t3 to t5.

The control signal S2 changes from the high level voltage to the low level voltage at time t3, so that the switch elements SW1 to SWn−1 of the switch circuit C2 change from on-states to off-states. Therefore, the source lines LS1 to LSn−1 of the source line group GS2 become the high impedance states HI in which they are disconnected from the video lines LV1 to LVn−1. As a result, the gray scale voltages for the source line group GS3 supplied to the video lines LV1 to LVn−1 during a period from times t3 to t4 are prevented from being supplied to the source lines LS1 to LSn−1 of the source line group GS2.

Further, the control signal S1' changes from the high level voltage to the low level voltage at time t3, so that the switch elements SWn of the switch circuit C1 changes on-states to off-states. Therefore, the source line LSn of the source line group GS1 becomes the high impedance states HI in which it is disconnected from the video line LVn. As a result, the gray scale voltages for the source line group GS3 supplied to the video line LVn during a period from times t3 to t5 are prevented from being supplied to the source line LSn of the source line group GS1.

It is noted that, at time t3, the control signal S2 changes from the high level voltage to the low level voltage, but the control signal S3 changes the low level voltage to the high level voltage. Since the control signals S2 and S3 change like this, the control signal S2' outputted from the OR circuit 22_2 keeps the high level voltage during not only a period from times t2 to t3 but also a period from times t3 to t4. As a result, the switch element SWn of the switch circuit C2 keeps on-state during a period from times t2 to t4, so that the source line LSn of the source line group GS2 becomes the low impedance state LI in which it is connected to the additional video line LVn+1 during a period from times t2 to t4. Therefore, the source line LSn of the source line group GS2 continues to be supplied with the corresponding gray scale voltage from the additional video line LVn+1 during a period from times t2 to t4. As a result of this, if the voltage on the source line LSn of the source line group GS2 varies due to the cross talk, the voltage on the source line LSn of the source line group GS2 returns to the original gray scale voltage, so that the degradation of the quality of image due to the cross talk is prevented.

The other source line groups GS3 to GSz−1 are also supplied with their respective gray scale voltages in the similar way. Therefore, the degradation of the quality of image due to the cross talk between the adjacent source line groups is prevented.

In the case of the last source line group GSz unlike the other source line groups GS1 to GSz−1, no source line group causing the cross talk exists. For such a reason, it is not necessary to supply the source line LSn of the last source line group GSz with the corresponding gray scale voltage during two clock periods. Therefore, in the case of the last source line group GSz, not only the source lines LS1 to LSn−1 but also the source line LSn are supplied with their respective gray scale voltages during only one clock period. For this purpose, the gray scale voltage for the source line LSn belonging to the source line group GSz is supplied to the additional video line LVn+1 during only a period from times tz to tz+1 (i.e. one clock period), and the control signal Sz outputted from the last D flip-flop FFz of the shift register 21 controls not only the switch elements SW1 to SWn−1 of the switch circuit Cz but also the switch element SWn. By controlling the switch circuit Cz with such control signal Sz, n source lines LS1 to LSn belonging to the last source line group GSz can be supplied with the gray scale voltages only for one clock period.

The voltage supplying device 1 of FIG. 3 supplies the source lines LSn of the source line groups with the gray scale voltages using two video lines LVn and LVn+1. However, the source lines LSn of the source line groups may be supplied with the gray scale voltages using three or more video lines.

Further, the voltage supplying device 1 of FIG. 3 generates each of the control signals S1', S2', . . . for controlling the switch element SWn using the two control signals outputted from the shift register 21. However, the control signals S1', S2', . . . are not necessarily required to be generated using the signals outputted from the shift register 21. The control signals S1', S2', . . . for controlling the switch elements SWn may be generated in any manner as long as the switch elements SWn can be controlled separately from the other switch elements SW1 to SWn−1.

FIG. 5 is a schematic diagram showing a voltage supplying device 2 of the second embodiment according to the present invention which is applied to an image display device. FIG. 6 shows a timing chart of the voltage supplying device 2 shown in FIG. 5.

FIGS. 5 and 6 are mainly explained about the differences between FIGS. 3 and 4.

The differences in constituent elements between the voltage supplying device 2 shown in FIG. 5 and the voltage supplying device 1 shown in FIG. 3 are as follows; the voltage supplying device 2 of FIG. 5 is not provided with the additional video line LVn+1 with which the voltage supplying device 1 is provided, the video line LVn of the voltage supplying device 2 of FIG. 5 is adapted to supply the source lines LSn of all source line groups with the gray scale voltages, and the voltage supplying device 2 of FIG. 5 is provided with a switch circuit controlling means 200 different from the switch circuit controlling means 20 of the voltage supplying device 1 of FIG. 3.

The video line LVn is supplied with the voltage in accordance with the different timing than the other video lines LV1 to LVn−1. This is specifically shown in a timing chart of FIG. 6. At the upper part of FIG. 6, voltage profiles of the video lines LV1 to LVn−1 and the video line LVn are shown in order from the top position. It is noted that the reference characters 'GS1', 'GS2', 'GS3' and others are described in the voltage profiles of the video lines. For example, in the voltage profiles of the video lines LV1 to LVn−1, the reference characters 'GS1', 'GS2', 'GS3', . . . , 'GSz' are described every one clock period. More specifically, for example between times t1 and t2, the reference character 'GS1' is described. This means that the gray scale voltages for source lines belonging to the source line group GS1 are supplied to the video lines LV1 to LVn−1 during a period from times t1 to t2. Similarly, the reference character 'GSz' is described between times tz and tz+1, which means that the gray scale voltages for source lines belonging to the source line group GSz are supplied to the video lines LV1 to LVn−1. In this way, the gray scale voltages for each of the source line groups are supplied to the video lines LV1 to LVn−1 every one clock period.

Similarly, in the voltage profiles of the video line LVn, the reference characters 'GS1', 'GS2', 'GS3', . . . , 'GSz' are described. Therefore, the gray scale voltage for source line LSn of each of the source line groups is supplied to the video line LVn. However, it is noted that the video line LVn is supplied with the corresponding gray scale voltages the delay period Pd later than the video lines LV1 to LVn−1.

The switch circuit controlling means 200 comprises a shift register 201 having the same structure as the shift register 21 show in FIG. 3. The control signals S1 to Sz outputted from the shift register 201 are supplied to their respective switch circuits C1 to Cz. It is noted that the control signals S1 to Sz do not control all of n switch elements SW1 to SWn of the corresponding the switch circuits C1 to Cz, but control (n−1) switch elements SW1 to SWn−1. For example, the control signal S1 does not control all of n switch elements SW1 to SWn of the corresponding switch circuit C1, but controls (n−1) switch elements SW1 to SWn−1. Ditto for the other control signals S2 to Sz. That is to say, it is noted that the control signals S1 to Sz can control n−1 switch elements SW1 to SWn belonging to the corresponding switch circuits, but can not control switch elements SWn. In order to control the switch element SWn which can not be controlled by the control signals S1 to Sz, the switch circuit controlling means 200 comprises z delay circuits 202_1 to 202_z corresponding to z switch circuits C1 to Cz (In FIG. 6, delay circuits 202_1, 202_2 and 202_z are shown, but the other delay circuits are omitted). The delay circuit 202_1 delays the control signal S1 inputted to the corresponding switch circuit C1 and then outputs the delayed control signal S1 as a control signal S1'. The opening and closing of the switch element SWn of the switch circuit C1 is performed by the control signal S1'. In a similar way, the other delay circuits 202_2 to 202_z output control signals S2' to Sz' for opening and closing the switch elements SWn of the corresponding switch circuits C2 to Cz, respectively.

Hereinafter, the operation of the voltage supplying device 2 is explained.

In order to supply the source lines LS1 to LSn−1 of the source line group GS1 with their respective gray scale voltages, the voltage supplying device 2 supplies the video lines LV1 to LVn−1 with the corresponding gray scale voltages during a period from times t1 to t2. Further, in order to supply the source line LSn of the source line group GS1 with the gray scale voltages, the voltage supplying device 2 supplies the video line LVn with the corresponding gray scale voltages, but it is noted that the video line LVn is supplied with the corresponding gray scale voltage the delay period Pd later than the video lines LV1 to LVn−1.

The D flip-flop FF1 takes the high level voltage of the carry signal Carry in synchronization with the rising edge of the pulse P1 and continues to output the high level voltage until the next pulse P2 rises. Therefore, the control signal S1 is the high level voltage during a period from times t1 to t2, so that the switch elements SW1 to SWn−1 of the switch circuit C1 become on-state. The source lines LS1 to LSn−1 of the source line group GS1 become the low impedance state LI (see FIG. 6) in which they are connected to the respective video lines LV1 to LVn−1 through the switch elements SW1 to SWn−1 in on-states. Therefore, the source lines LS1 to LSn−1 of the source line group GS1 are supplied with the respective gray scale voltages from the video lines LV1 to LVn−1. The control signal S1 is inputted to not only the switch circuit C1 but also the delay circuit 202_1. The delay circuit 202_1 delays the control signal S1 by the delay period Pd and then outputs the delayed control signal S1 as the control signal Sr. Therefore, the switch element SWn becomes on-state the delay period Pd later than the switch elements SW1 to SWn−1, so that the source line LSn of the source line group GS1 becomes the low impedance state LI the delay period Pd later than the source lines LS1 to LSn−1 of the source line group GS1 (see FIG. 6).

Next, in order to supply the source lines LS1 to LSn−1 of the source line group GS2 with the gray scale voltages, the video lines, LV1 to LVn−1 are supplied with the corresponding gray scale voltages during a period from times t2 to t3. Therefore, during a period from times t1 to t2 the gray scale voltages for the source line group GS1 are supplied to the video lines LV1 to LVn−1, but during a period from times t2 to t3 the gray scale voltages for the adjacent source line group GS2 are supplied to the video lines LV1 to LVn−1. However, it is noted that the gray scale voltage for the source line LSn belonging to the source line group GS1 is supplied to the video line LVn until the time t2' which is later than the time t2 by the delay period Pd. This reason is described later.

Further, at time t2, the control signal S1 changes from the high level voltage to the low level voltage, so that the switch elements SW1 to SWn−1 of the switch circuit C1 change from on-states to off-states. Therefore, the source lines LS1 to LSn−1 of the source line group GS1 become the high impedance states HI in which they are disconnected from the respective video lines LV1 to LVn−1. As a result, the gray scale voltages for the source line group GS2 supplied to the video lines LV1 to LVn−1 during a period from times t2 to t3 are prevented from being supplied to the source lines LS1 to LSn−1 of the source line group GS1.

Furthermore, at time t2, the control signal S2 changes from the low level voltage to the high level voltage, so that the switch elements SW1 to SWn−1 of the switch circuit C2 change from off-states to on-states. The source lines LS1 to LSn−1 of the source line group GS2 become the low impedance states LI in which they are connected to the respective video lines LV1 to LVn−1 through the switch elements SW1 to SWn−1 in on-states. Therefore, the source lines LS1 to LSn−1 of the source line group GS2 are supplied with the corresponding gray scale voltages from the video lines LV1 to LVn−1.

It is noted that, at time t2, the control signal S2 changes from the low level voltage to the high level voltage, but the delay signal S1' changes from the high level voltage to the low level voltage after the delay period Pd with respect to time t2. Therefore, the switch element SWn of the switch circuit C1 keeps on-state until the time t2' after passing time t2. As a result of this, the source line LSn of the source line group GS1 becomes low impedance state LI in which it is connected to the video line LVn during a period from times t1' to t2', so that the source line LSn of the source line group GS1 is supplied with the corresponding gray scale voltage from the video line LVn. That is to say, the source line LSn of the source line group GS1 continues to be supplied with the corresponding gray scale voltage from the video line LVn while the source line LS1 of the source line group GS2 changes from the high impedance state HI to the low impedance state LI at time t2. Therefore, if the voltage on the source line LSn of the source line group GS1 varies due to the cross talk at the instance when the source line L1 of the source line group GS2 becomes the low impedance state LI (time t2), the voltage on the source line LSn of the source line group GS1 returns to the original gray scale voltage instantaneously. In this way, the degradation of the quality of image due to the cross talk is prevented. The delay period Pd described above may be decided from the viewpoint of how long the source line LSn must be supplied with the corresponding gray scale voltage for returning the varied voltage on the source line LSn due to the cross talk to the original gray scale voltage.

Further, during a period from times t2' to t3', the gray scale voltage for the source line LSn of the source line group GS2 is supplied to the video line LVn. At time t2', the control signal S2' changes from the low level voltage to the high level voltage, so that the switch element SWn of the switch circuit C2 changes from off-state to on-state. The source line LSn of the source line group GS2 becomes the low impedance state LI in which it is connected to the video line LVn through the switch element SWn in on-state. Therefore, the source line LSn of the source line group GS2 is supplied with the corresponding gray scale voltage from the video line LVn.

The source line groups GS3 to GSz are also supplied with the corresponding gray scale voltages in the similar manner. Therefore, the degradation of the quality of image due to the cross talk between the source line groups adjacent to each other is prevented.

In the voltage supplying device 2 shown in FIG. 5, the video line LVn is supplied with the corresponding gray scale voltage the delay period Pd later than the other video lines LV1 to LVn−1 in order to prevent from degrading the quality of image. Therefore, when the last source line group GSz is supplied with the gray scale voltage, the switch element SWn of the corresponding switch circuit Cz is required to become on-state the delay period Pd later than the other switch elements SW1 to SWn−1. For this purpose, the voltage supplying device 2 shown in FIG. 5 comprises the delay circuit 202_z corresponding to the last switch circuit Cz and controls the switch elements of the last switch circuit Cz with two control signals Sz and Sz'. Therefore, in the switch circuit Cz, the switch elements SW1 to SWn−1 change from on-state to off-state at time tz+1, but the switch element SWn changes from on-state to off-state at time tz+1' which is later than time tz+1 by the delay period Pd. However, in the case of the last source line group GSz, unlike the other source line groups GS1 to GSz−1, no source line group causing the cross talk exists, so that the switch element SWn of the switch circuit Cz may be changed from on-state to off-state at the same time tz+1 as the other switch elements SW1 to SWn−1.

Further, the voltage supplying device 2 of FIG. 5 generates the control signals S1', S2', . . . for controlling the switch elements SWn, using control signals outputted from the shift register 21. However, it is not necessary to generate the control signals S1', S2', . . . using the signals outputted from the shift register 21. The control signals S1', S2', . . . for controlling the switch elements SWn may be generated in any manner as long as the switch elements SWn can be controlled separately from the other switch elements SW1 to SWn−1.

Furthermore, the voltage supplying device according to the present invention is applied to the image display device in the first and second embodiments described above. However, it is noted that the voltage supplying device according to the present invention may be applied to different devices, which are required to prevent the voltage on the line from deviating from the desired voltage due to the cross talk, from the image display device.

INDUSTRIAL APPLICABILITY

The present invention can be applied to the devices (for example, an image display device such as a liquid crystal display device) required to prevent the voltage on the line from deviating from the desired voltage due to the cross talk.

The invention claimed is:

1. A voltage supplying device comprising:

a first relaying line;

a second relaying line;

a first voltage line supplied with a voltage through said first relaying line;

a second voltage line supplied with a voltage through said second relaying line;

a third voltage line supplied with a voltage through said first relaying line, said third voltage line adjacent to said second voltage line;

a controlling means for continuing to supply said second voltage line with a voltage during a transition from a first voltage supplying state in which said first voltage line is supplied with a voltage to a second voltage supplying state in which said third voltage line is supplied with a voltage;

an additional relaying line;

a first voltage line group having said first voltage line and said second voltage line; and a second voltage line group having said third voltage line and a fourth voltage line supplied with a voltage through said additional relaying line; and a fifth voltage line supplied with a voltage through said first relaying line, said fifth voltage line adjacent to said fourth voltage line, wherein said controlling means continues to supply said fourth relaying line with a voltage through said additional relaying line during a transition from a state in which said third voltage line is supplied with a voltage through said first relaying line to a state in which said fifth voltage line is supplied with a voltage through said first relaying line.

2. A voltage supplying device as claimed in claim 1, wherein said controlling means supplies said first relaying line with a voltage for said third voltage line after supplying said first relaying line with a voltage for said first voltage line, and wherein said controlling means continues to supply said second relaying line with a voltage for said second voltage line during a transition from a state in which said first relaying line is supplied with said voltage for said first voltage line to a state in which said first relaying line is supplied with said voltage for said third voltage line.

3. A voltage supplying device as claimed in claim 2, wherein said controlling means is adapted to switch from a disconnection state in which said third voltage line is disconnected from said first relaying line to a connection state in which said third voltage line is connected to said first relaying line, and wherein said controlling means continues to supply said second voltage line with said voltage for said second voltage line through said second relaying line during a transition from a disconnection state in which said third voltage line is disconnected from said first relaying line to a connection state in which said third voltage line is connected to said first relaying line.

4. A voltage supplying device as claimed in claim 3, wherein said controlling means is further adapted to switch from a disconnection state in which said second voltage line is disconnected from said second relaying line to a connection state in which said second voltage line is connected to said second relaying line, and wherein said controlling means continues to keep a connection state in which said second voltage line is connected to said second relaying line during a transition from a disconnection state in which said third voltage line is disconnected from said first relaying line to a connection state in which said third voltage line is connected to said first relaying line.

5. A voltage supplying device as claimed in claim 4, wherein said controlling means comprises:

a first switching means for making a connection state in which said first voltage line is connected to said first relaying line and a disconnection state in which said first voltage line is disconnected from said first relaying line;

a second switching means for making a connection state in which said second voltage line is connected to said second relaying line and a disconnection state in which said second voltage line is disconnected from said second relaying line; and a third switching means for making a connection state in which said third voltage line is connected to said first relaying line and a disconnection state in which said third voltage line is disconnected from said first relaying line, and wherein said controlling means comprises a switch controlling means for controlling said first, second, and third switching means in such a way that a connection state in which said second voltage line is connected to said second relaying line is kept during a transition from a first state in which said first voltage line is connected to said first relaying line and said third voltage line is disconnected from said first relaying line to a second state in which said first voltage line is disconnected from said first relaying line and said third voltage line is connected to said first relaying line.

6. A voltage supplying device as claimed in claim 5, wherein said first switching means connects said first voltage line to said first relaying line in its on state and disconnects said first voltage line from said first relaying line in its off state, wherein said second switching means connects said second voltage line to said second relaying line in its on state and disconnects said second voltage line from said second relaying line in its off state, wherein said third switching means connects said third voltage line to said first relaying line in its on state and disconnects said third voltage line from said first relaying line in its off state, and wherein said switch controlling means controls said first, second, and third switching means in such a way that said second switching means keeps on state during a transition of said first switching means from on state to off state and a transition of said third switching means from off state to on state.

7. A voltage supplying device as claimed in claim 6, wherein said switch controlling means outputs a first control signal for controlling said first switching means, a second control signal for controlling said second switching means, and a third control signal for controlling said third switching means, wherein said first control signal has an first on-voltage for turning said first switching means to an on-state and an first off-voltage for turning said first switching means to an off-state, wherein said second control signal has an second on-voltage for turning said second switching means to an on-state and an second off-voltage for turning said second switching means to an off-state, wherein said third control signal has an third on-voltage for turning said third switching means to an on-state and an third off-voltage for turning said third switching means to an off-state, wherein said switch controlling means outputs said first and third control signals in such a way that a transition of said third control signal from said third off-voltage to said third on-voltage is made when a transition of said first control signal from said first on-voltage to said first off-voltage is made, and wherein said switch controlling means outputs said second control signals in such a way that said second control signal has said second on-voltage during a transition of said third control signal from said third off-voltage to said third on-voltage.

8. A voltage supplying device as claimed in claim 7, wherein said switch controlling means comprises an OR circuit for implementing the logic sum of said first control signal and said third control signal to output a signal representing said logic sum of said first and second control signals as said second control signal.

9. A voltage supplying device as claimed in claim 7, wherein said switch controlling means comprises an delay circuit for delaying said first control signal to output said delayed first control signal as said second control signal.

10. A voltage supplying device as claimed in claim 1, wherein said controlling means blocks the supply of the voltage to said second voltage line after said transition from said first voltage supplying state to said second voltage supplying state.

11. A voltage supplying device comprising:

a first relaying line;

a second relaying line;

a first voltage line supplied with a voltage through said first relaying line;

a second voltage line supplied with a voltage through said second relaying line;

a third voltage line supplied with a voltage through said first relaying line, said third voltage line adjacent to said second voltage line;

a controlling means for switching from a first voltage supplying state in which said first voltage line is supplied with a voltage to a second voltage supplying state in which said third voltage line is supplied with a voltage during supply of a voltage to said second voltage line;

an additional relaying line;

a first voltage line group having said first voltage line and said second voltage line; and a second voltage line group having said third voltage line and a fourth voltage line supplied with a voltage through said additional relaying line; and a fifth voltage line supplied with a voltage through said first relaying line, said fifth voltage line adjacent to said fourth voltage line, wherein said controlling means continues to supply said fourth relaying line with a voltage through said additional relaying line during a transition from a state in which said third voltage line is supplied with a voltage through said first relaying line to a state in which said fifth voltage line is supplied with a voltage through said first relaying line.

12. A voltage supplying device comprising:

a first relaying line;

a second relaying line;

a first voltage line supplied with a voltage through said first relaying line;

a second voltage line supplied with a voltage through said second relaying line;

a third voltage line supplied with a voltage through said first relaying line, said third voltage line adjacent to said second voltage line;

a controller continuing to supply said second voltage line with a voltage during a transition from a first voltage supplying state in which said first voltage line is supplied with a voltage to a second voltage supplying state in which said third voltage line is supplied with a voltage;

an additional relaying line;

a first voltage line group having said first voltage line and said second voltage line; and a second voltage line group having said third voltage line and a fourth voltage line supplied with a voltage through said additional relaying line; and a fifth voltage line supplied with a voltage through said first relaying line, said fifth voltage line adjacent to said fourth voltage line, wherein said controlling means continues to supply said fourth relaying line with a voltage through said additional relaying line during a transition from a state in which said third voltage line is supplied with a voltage through said first relaying line to a state in which said fifth voltage line is supplied with a voltage through said first relaying line.

13. A voltage supplying device as claimed in claim 12, wherein said controller supplies said first relaying line with a voltage for said third voltage line after supplying said first relaying line with a voltage for said first voltage line, and wherein said controller continues to supply said second relaying line with a voltage for said second voltage line during a transition from a state in which said first relaying line is supplied with said voltage for said first voltage line to a state in which said first relaying line is supplied with said voltage for said third voltage line.

14. A voltage supplying device as claimed in claim 13, wherein said controller is adapted to switch from a disconnection state in which said third voltage line is disconnected from said first relaying line to a connection state in which said third voltage line is connected to said first relaying line, and wherein said controller continues to supply said second voltage line with said voltage for said second voltage line through said second relaying line during a transition from a disconnection state in which said third voltage line is disconnected from said first relaying line to a connection state in which said third voltage line is connected to said first relaying line.

15. A voltage supplying device as claimed in claim 14, wherein said controller is further adapted to switch from a disconnection state in which said second voltage line is disconnected from said second relaying line to a connection state in which said second voltage line is connected to said second relaying line, and wherein said controller continues to keep a connection state in which said second voltage line is connected to said second relaying line during a transition from a disconnection state in which said third voltage line is disconnected from said first relaying line to a connection state in which said third voltage line is connected to said first relaying line.

16. A voltage supplying device as claimed in claim 15, wherein said controller comprises:

a first switch making a connection state in which said first voltage line is connected to said first relaying line and a disconnection state in which said first voltage line is disconnected from said first relaying line;

a second switch making a connection state in which said second voltage line is connected to said second relaying line and a disconnection state in which said second voltage line is disconnected from said second relaying line; and a third switch making a connection state in which said third voltage line is connected to said first relaying line and a disconnection state in which said third voltage line is disconnected from said first relaying line, and wherein said controller comprises a switch controller controlling said first, second, and third switches in such a way that a connection state in which said second voltage line is connected to said second relaying line is kept during a transition from a first state in which said first voltage line is connected to said first relaying line and said third voltage line is disconnected from said first relaying line to a second state in which said first voltage line is disconnected from said first relaying line and said third voltage line is connected to said first relaying line.

17. A voltage supplying device as claimed in claim 16, wherein said first switch connects said first voltage line to said first relaying line in its on state and disconnects said first voltage line from said first relaying line in its off state, wherein said second switch connects said second voltage line to said second relaying line in its on state and disconnects said second voltage line from said second relaying line in its off state, wherein said third switch connects said third voltage line to said first relaying line in its on state and disconnects said third voltage line from said first relaying line in its off state, and wherein said switch controller controls said first, second, and third switch in such a way that said second switch keeps on state during a transition of said first switch from on state to off state and a transition of said third switch from off state to on state.

18. A voltage supplying device as claimed in claim 17, wherein said switch controller outputs a first control signal for controlling said first switch, a second control signal for controlling said second switch, and a third control signal for controlling said third switch, wherein said first control signal has an first on-voltage for turning said first switch to an on-state and an first off-voltage for turning said first switch to an off-state, wherein said second control signal has an second on-voltage for turning said second switch to an on-state and an second off-voltage for turning said second switch to an off-state, wherein said third control signal has an third on-voltage for turning said third switch to an on-state and an third off-voltage for turning said third switch to an off-state, wherein said switch controller outputs said first and third control signals in such a way that a transition of said third control signal from said third off-voltage to said third on-voltage is made when a transition of said first control signal from said first on-voltage to said first off-voltage is made, and wherein said switch controller outputs said second control signals in such a way that said second control signal has said second on-voltage during a transition of said third control signal from said third off-voltage to said third on-voltage.

* * * * *